US006661319B2

(12) United States Patent
Schmelz

(10) Patent No.: US 6,661,319 B2
(45) Date of Patent: Dec. 9, 2003

(54) BOUNCE-REDUCED RELAY

(75) Inventor: Rainer Schmelz, Wellendingen (DE)

(73) Assignee: Gruner AG (DE)

( * ) Notice: Subject to any disclaimer, the term of this patent is extended or adjusted under 35 U.S.C. 154(b) by 16 days.

(21) Appl. No.: 10/310,346

(22) Filed: Dec. 5, 2002

(65) Prior Publication Data

US 2003/0112103 A1 Jun. 19, 2003

(30) Foreign Application Priority Data

Dec. 19, 2001 (DE) ..... 101 62 585

(51) Int. Cl.[7] ..... H01H 3/00
(52) U.S. Cl. ..... 335/78; 335/128
(58) Field of Search ..... 335/78, 80, 83, 335/124, 128, 129

(56) References Cited

U.S. PATENT DOCUMENTS 4,092,620 A * 5/1978 Schuessler et al. ..... 335/128
4,701,734 A * 10/1987 Nakano et al. ..... 335/128
4,956,623 A * 9/1990 Kimpel Rolf-Dieter ..... 335/128
5,329,265 A * 7/1994 Guidi et al. ..... 335/78
5,534,834 A * 7/1996 Hendel ..... 335/78
5,703,549 A * 12/1997 Guidi et al. ..... 335/78
5,892,423 A * 4/1999 Haas et al. ..... 335/128
6,426,689 B1 * 7/2002 Nakagawa et al. ..... 335/78
2002/0050885 A1 * 5/2002 Gruner ..... 335/129

FOREIGN PATENT DOCUMENTS

DE 93 20 696.8 10/1994

* cited by examiner

*Primary Examiner*—Elvin Enad
*Assistant Examiner*—Bernard Rojas
(74) *Attorney, Agent, or Firm*—Walter A. Hackler

(57) ABSTRACT

A relay includes a contact spring which closes or interrupts an electric circuit between a first and a second relay contact. One end of the contact spring is conductively connected to the first relay contact and another free end of the contact spring closes or interrupts the electric circuit in a first end position of the contact spring and in a second end position of the contact spring, respectively. An armature is provided which can be adjusted by a reversible magnetic field for deflecting the contact spring into the respective end position. An additional spring is provided for biasing the contact spring into the first end position, wherein the additional spring is supported, at least in the first end position, on the armature or on an actuator of the armature.

15 Claims, 3 Drawing Sheets

BOUNCE-REDUCED RELAY

This application claims Paris Convention Priority of DE 101 62 585.5 filed Dec. 19, 2001, the complete disclosure of which is hereby incorporated reference.

BACKGROUND OF THE INVENTION

The invention concerns a relay comprising a contact spring which closes or interrupts the electric circuit between a first and a second relay contact, one end of the contact spring being conductively connected to the first relay contact and its other free end closing or interrupting the electric circuit in a first end position of the contact spring and in a second end position of the contact spring, respectively; an armature which can be adjusted by a reversible magnetic field for deflecting the contact spring into the respective end position; and an additional spring biasing the contact spring into the first end position.

A relay of this type is known e.g. from DE 93 20 696 U1.

In this known relay, an electric circuit between two electric relay contacts is closed or interrupted by a contact spring. The contact spring is connected to a permanent magnet of an H-type armature via a displaceable actuator, the permanent magnet being pivotably disposed on two yoke legs of a magnet coil. When the poles of the magnet coil are reversed, the permanent magnet is pivoted thereby displacing the actuator. Since the actuator engages behind the contact spring, the contact spring is deflected from its closed rest position such that the electric circuit is interrupted. The free end of the contact spring is biased towards the closed end position through a leaf spring which is mounted on the side of the housing and acts on an actuating button of the contact spring.

It is the object of the invention to bias the contact spring of a relay of the above-mentioned type in a different fashion in the direction towards the closed end position.

SUMMARY OF THE INVENTION

This object is achieved in accordance with the invention in that the additional spring is supported, at least in the first end position, on the armature or on an actuator of the armature.

The advantage obtained by the invention consists in bounce-reduced switching of the relay into the closed relay position since the additional spring counteracts deflection of the contact spring in the opening direction when the relay is in the closed position.

The additional spring is mounted to the armature or to the actuator of the armature or in particularly preferred embodiments of the invention to the contact spring, in particular to its free end.

The additional spring is preferably a flat or leaf spring from electrically conducting material such as e.g. steel, beryllium, Cu-alloys etc.

In one variant of the invention, the free end of the additional spring is directed towards the free end of the contact spring. The free end of the additional spring preferably projects past the free end of the contact spring.

In other variants of the invention, the free end of the additional spring can also project laterally past the contact spring or be directed away from the free end of the contact spring.

The actuator is preferably disposed such that it can be linearly displaced approximately in the deflecting direction of the contact spring and is motionally coupled to the free end of the contact spring.

In preferred embodiments of the invention, the contact spring is directly coupled with the armature or the actuator of the armature in the opening direction of the relay, and is motionally coupled thereto in the closing direction of the relay via the additional spring. In one variant, the actuator engages behind the free end of the contact spring and carries along the contact spring in the opening direction.

In a preferred embodiment of the invention, the actuator is directly hinged to the armature and therewith directly motionally coupled to the armature. The pressure of the contact spring on the second relay contact is provided by the pressure force of the compressed additional spring.

In another preferred embodiment of the invention, the actuator is motionally coupled with the armature by means of a coupling spring acting therebetween. The pressure of the contact spring on the second relay contact is provided by the pressure of the compressed additional spring and the compressed coupling spring.

Further advantages of the invention can be extracted from the description and the drawing. The features mentioned above and below can be utilized in accordance with the invention either individually or collectively in any arbitrary combination. The embodiments shown and described are not to be understood as exhaustive enumeration but rather have exemplary character for describing the invention.

DETAILED DESCRIPTION

Figure 1:
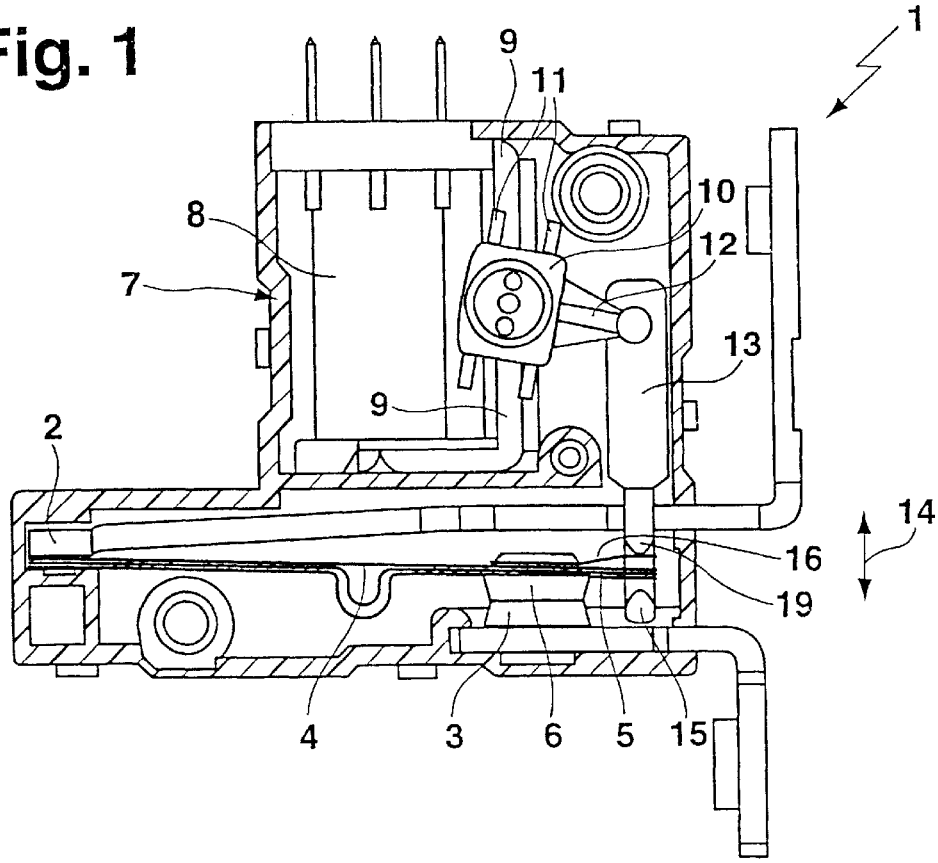
FIG. 1 shows an interior view of the inventive relay in the closed relay position in which a contact spring closes the electric circuit between two relay contacts, with removed cover.
Figure 2:
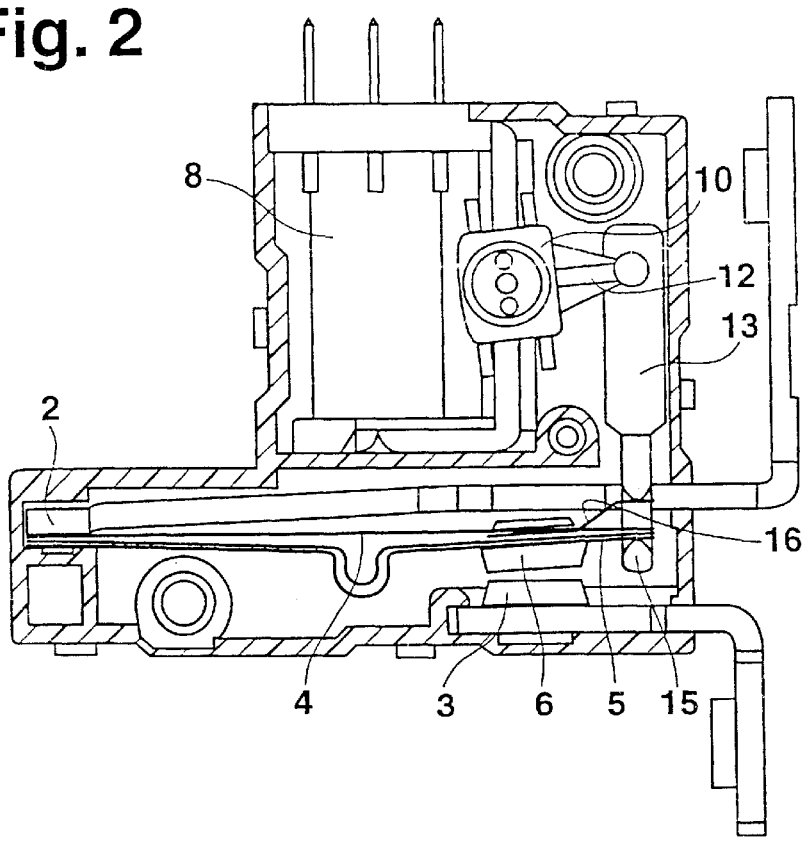
FIG. 2 shows the relay of FIG. 1 in the open relay position in which the contact spring interrupts the electric circuit between the two relay contacts.

The relay 1 shown in FIGS. 1 and 2 comprises two relay contacts 2, 3 and a contact spring 4 which closes or interrupts the electric circuit between the two relay contacts 2, 3 and is formed as electrically conducting leaf or flat spring. One end of the contact spring 4 is mounted in an electrically conducting fashion to the first relay contact 2 while the other free end 5 bears a contact button 6 and can be deflected by means of a magnetic drive 7. The contact spring 4 is deflected to the bottom in the closed relay position shown in FIG. 1 such that the contact button 6 abuts the second relay contact 3 and is deflected in the open relay position shown in FIG. 2 such that the contact button 6 is lifted from the second relay contact 3.

The magnet drive 7 comprises a reversible magnet coil 8 having an iron core with two yoke legs 9 pivotably holding an armature 10 with a permanent magnet (not shown). The permanent magnet is disposed between two armature plates 11 which each abut the yoke legs 9 in the two switching positions of the armature 10. The magnet coil 8 and the armature 10 which can be pivoted between its two switching positions form an H-type armature pull.

Figure 3:
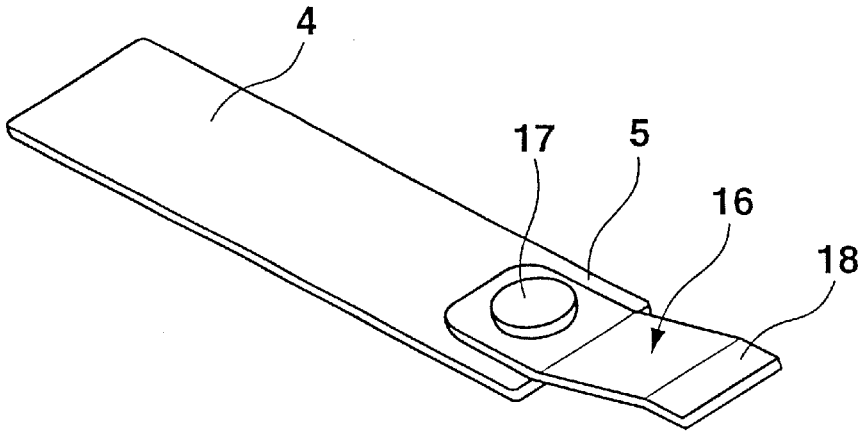
FIG. 3 shows an additional spring of the relay of FIGS. 1 and 2 disposed on the contact spring.

An actuator 13 formed as one-piece arm is hinged to a projecting arm 12 of the armature 10, wherein the actuator 13 is disposed such that it can be linearly displaced in the deflecting direction (double arrow 14) of the contact spring 4. The actuator 13 engages with a projection 15 below the free end 5 of the contact spring 4 whereby the actuator 13 carries along or deflects the contact spring 4 in the opening direction of the relay 1 i.e. upwardly. The contact spring 4 is motionally coupled to the actuator 13 in the closing direction, i.e. downwardly, by means of an additional spring 16 supported on the actuator 13. In the embodiment shown, the additional spring 16 is formed as leaf spring which is mounted by means of a rivet 17 on top of the contact spring 4, shown in FIG. 3, and whose free end 18 cooperates with a downwardly directed projection 19 of the actuator 13. As shown in FIG. 3, the free end 18 of the additional spring 16 projects past the free end 5 of the contact spring 4 in the longitudinal direction, i.e. in the direction away from the first relay contact 2.

For switching the relay 1, the magnetic field of the magnet coil 8 is reversed thereby pivoting the armature 10 and displacing the actuator 13. In the closed relay position (FIG. 1), the actuator 13 is displaced downwardly by the downwardly pivoted arm 12, whereby also the contact spring 4 is deflected downwardly via the additional spring 16 until its contact button 6 abuts the second relay contact 3. The pressure of the contact button 6 on the second relay contact 3 is provided by the pressure of the additional spring 16 compressed by the actuator 13. In the open relay position (FIG. 2), the actuator 13 is displaced upwardly through the upwardly pivoted arm 12 thereby carrying along the contact spring 4 from the projection 15 of the actuator 13 and lifting the contact button 6 from the second relay contact 3.

Figure 4:
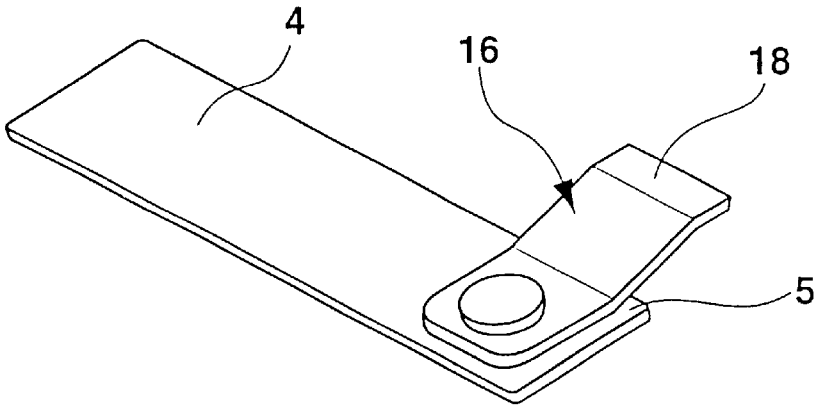
FIG. 4 shows an arrangement variant of the additional spring in a representation analog to FIG. 3.

In the variant shown in FIG. 4, the free end 18 of the additional spring 16 which cooperates with the actuator 13 projects laterally past the free end 5 of the contact spring 4.

Figure 5:
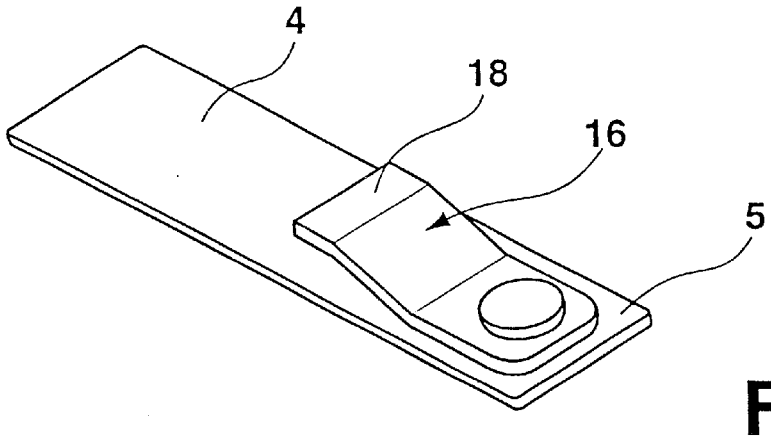
FIG. 5 shows another arrangement variant of the additional spring in a representation analog to FIG. 3.

In the variant of FIG. 5, the free end 18 of the pressure spring 16 is directed away from the free end 5 of the contact spring, i.e. in a direction back to the first relay contact 2, for cooperation with the actuator 13.

Figure 6:
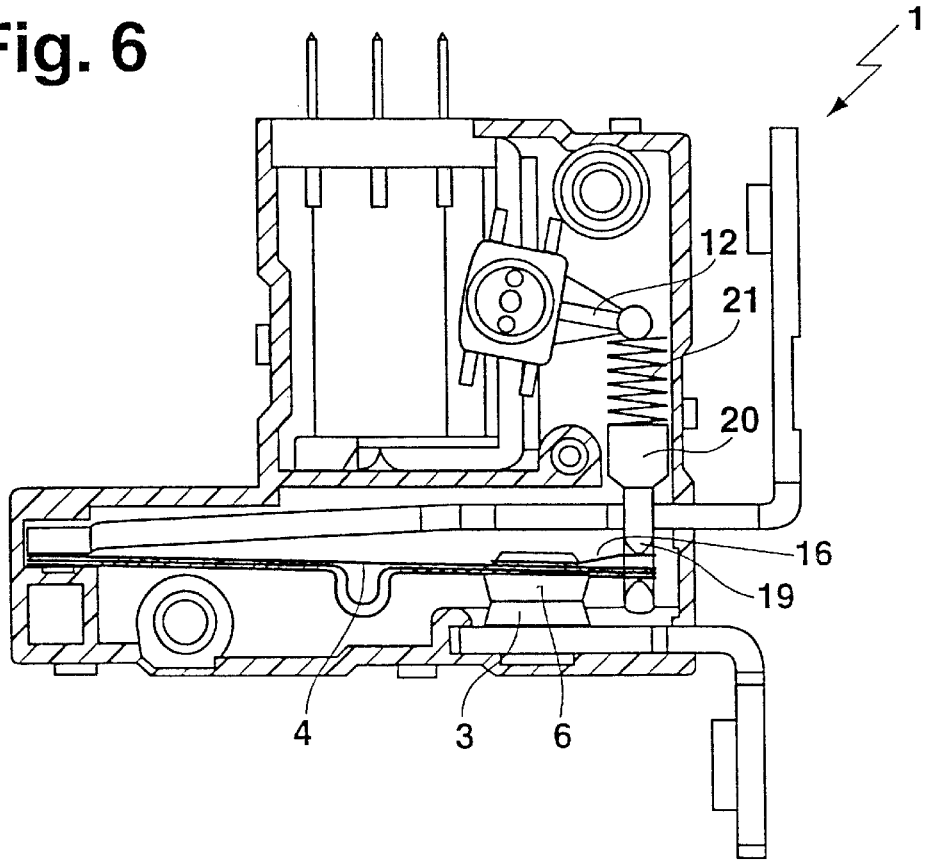
FIG. 6 shows a second embodiment of the inventive relay in the closed relay position.
Figure 7:
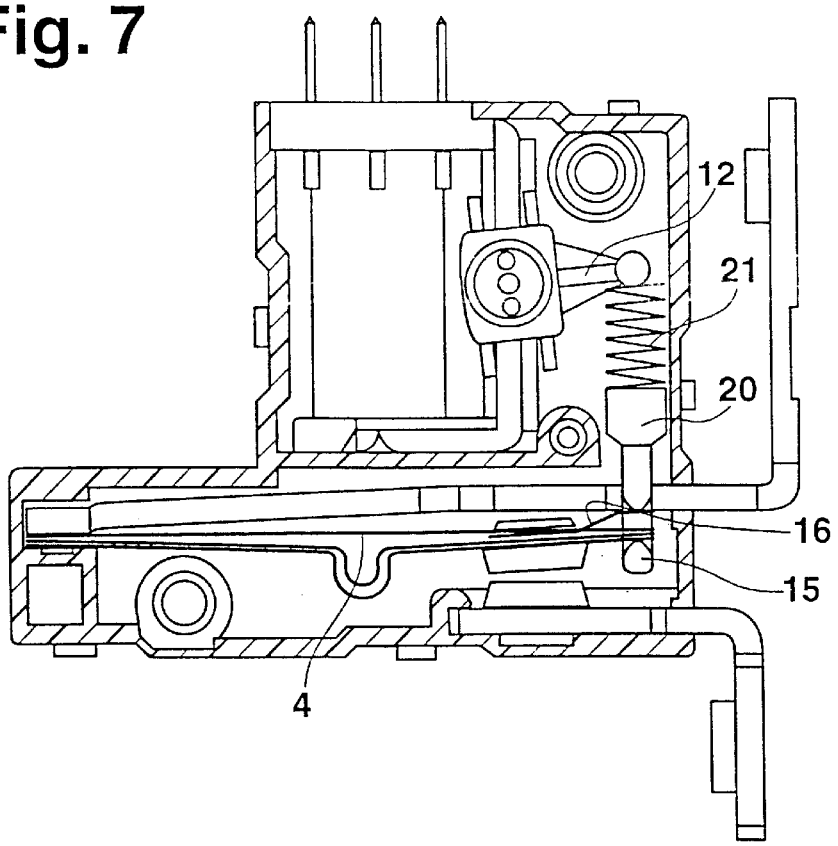
FIG. 7 shows the relay of FIG. 6 in the opened relay position.

In the relay 1 of FIGS. 6 and 7, the actuator 20 which cooperates with the contact spring 4 is shorter and is motionally coupled to the arm 12 via a coupling spring 21 which is supported between the actuator 20 and the arm 12. In the closed relay position (FIG. 6) the actuator 20 is displaced downwardly by the downwardly pivoted arm 12 and the coupling spring 21, whereby the contact spring 4 is also deflected downwardly through the additional spring 16 until the contact button 6 abuts the second relay contact 3. The pressure of the contact button 6 on the second relay contact 3 is provided by the pressure of the two compressed springs 16, 21. In the open relay position (FIG. 7), the actuator 20 is pulled upwards by the upwardly pivoted arm 12 via the coupling spring 21 whereby the contact spring 4 is carried along from the projection 15 of the actuator 13 and the contact button 6 is lifted from the second relay contact 3.

What is claimed is:

1. Relay comprising a contact spring which closes or interrupts an electric circuit between a first and a second relay contact, one end of the contact spring being conductively connected to the first relay contact and its other free end closing or interrupting the electric circuit in a first end position of the contact spring and in a second end position of the contact spring, respectively; an armature which can be adjusted by a reversible magnetic field for deflecting the contact spring into the respective end position; and an additional spring biasing the contact spring into the first end position, wherein the additional spring is supported, at least in the first end position, on the armature or on an actuator of the armature and mounted to a free end of the contact spring.

2. Relay according to claim 1, wherein the additional spring is mounted to the armature or to the actuator.

3. Relay according to claim 1, wherein the additional spring is formed as leaf spring.

4. Relay according to claim 3, wherein the free end of the additional spring is directed towards the free end of the contact spring.

5. Relay comprising a contact spring which closes or interrupts an electric circuit between a first and a second relay contact, one end of the contact spring being conductively connected to the first relay contact and its other free end closing or interrupting the electric circuit in a first end position of the contact spring and in a second end position of the contact spring, respectively; an armature which can be adjusted by a reversible magnetic field for deflecting the contact spring into the respective end position; and an additional spring biasing the contact spring into the first end position, wherein the additional spring is supported, at least in the first end position, on the armature or on an actuator of the armature and wherein a free end of the additional spring projects past the free end of the contact spring.

6. Relay according to claim 3, wherein the free end of the additional spring projects laterally past the contact spring.

7. Relay according to claim 3, wherein the free end of the additional spring is directed away from the free end of the contact spring.

8. Relay according to claim 1, wherein the actuator is disposed such that it can be linearly displaced in the direction of the contact spring.

9. Relay according to claim 3, wherein the contact spring is coupled directly to the armature or the actuator in the opening direction of the relay and is motionally coupled via the additional spring in the closing direction of the relay.

10. Relay according to claim 1, wherein the actuator is directly hinged to the armature.

11. Relay according to claim 1, wherein the actuator is motionally coupled to the armature via a coupling spring acting therebetween.

12. Relay comprising a contact spring which closes or interrupts an electric circuit between a first and a second relay contact, one end of the contact spring being conductively connected to the first relay contact and its other free end closing or interrupting the electric circuit in a first end position of the contact spring and in a second end position of the contact spring, respectively; an armature which can be adjusted by a reversible magnetic field for deflecting the contact spring into the respective end position; and an additional spring biasing the contact spring into the first end position, wherein the additional spring is supported, at least in the first end position, on the armature or on an actuator of the armature the additional spring being formed as leaf spring, the actuator being disposed such that it can be linearly displaced in the direction of deflection of the contact spring, and the actuator is directly hinged to the armature.

13. Relay according to claim 1, wherein the additional spring is mounted to the armature or to the actuator, the additional spring is formed as leaf spring, the actuator is disposed such that it can be linearly displaced approximately in the direction of deflection of the contact spring, and wherein the actuator is motionally coupled to the armature via a coupling spring acting therebetween.

14. Relay according to claim 1, wherein the additional spring is mounted to the armature or to the actuator, the additional spring is as leaf spring, the contact spring is coupled directly to the armature or the actuator in the opening direction of the relay and is motionally coupled via the additional spring in the closing direction of the relay, and wherein the actuator is directly hinged to the armature.

15. Relay according to claim 1, wherein the additional spring is mounted to the armature or to the actuator, the additional spring is formed as leaf spring, the contact spring is coupled directly to the armature or the actuator in the opening direction of the relay and is motionally coupled via the additional spring in the closing direction of the relay, and wherein the actuator is motionally coupled to the armature via a coupling spring acting therebetween.

* * * * *